United States Patent [19]

Geitner et al.

[11] 4,239,450

[45] Dec. 16, 1980

[54] ADJUSTING MECHANISM FOR VARIABLE INLET VANE

[75] Inventors: Lawrence J. Geitner, Angola; Christian C. Herbeck, Kenmore, both of N.Y.

[73] Assignee: Buffalo Forge Company, Buffalo, N.Y.

[21] Appl. No.: 39,588

[22] Filed: May 17, 1979

[51] Int. Cl.[3] ..... F04D 29/46

[52] U.S. Cl. ..... 415/160

[58] Field of Search ..... 415/60, 61, 62

[56] References Cited

U.S. PATENT DOCUMENTS

| | | | |
|---|---|---|---|
| 2,063,174 | 12/1936 | Leonard | 415/160 |
| 2,606,713 | 8/1952 | Bauger | 415/160 |
| 2,923,459 | 2/1960 | Taylor | 415/160 |
| 3,074,689 | 1/1963 | Chapman | 415/160 |
| 3,289,919 | 12/1966 | Wood | 415/160 |
| 3,352,537 | 11/1967 | Petrie | 415/160 |
| 3,392,958 | 7/1968 | Penny et al. | 415/160 |
| 3,954,349 | 5/1976 | Abild | 415/160 |

*Primary Examiner*—Louis J. Casaregola

*Attorney, Agent, or Firm*—Joseph P. Gastel

[57] ABSTRACT

A variable inlet vane adjusting construction including a plurality of vanes pivotally mounted about a hub, an adjusting ring circumferentially slidable on the hub, a plurality of circumferentially spaced axial slots on the adjusting ring, a bearing of substantially solid rectangular configuration in each of the slots and in engagement with the sides of the slots, a plurality of pin members each having first and second ends with the first ends being mounted for universal movement on each of said bearings and the second ends fixedly mounted on levers which are in turn fixedly secured to the vanes.

4 Claims, 9 Drawing Figures

Fig. 5.
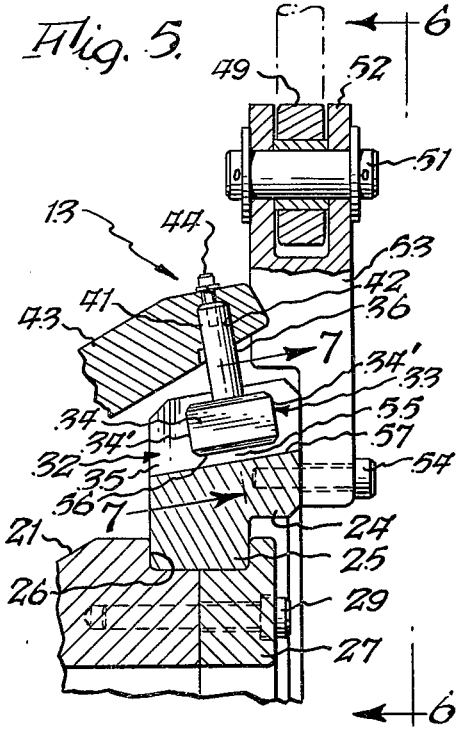
Fig. 7.
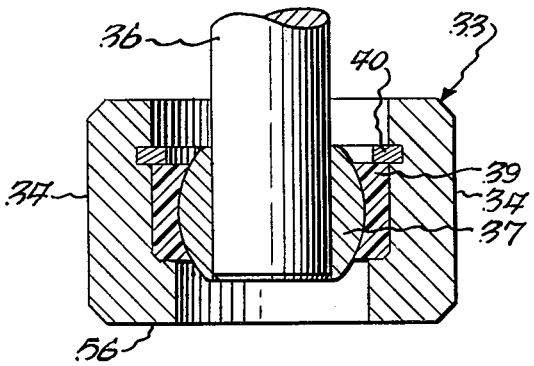
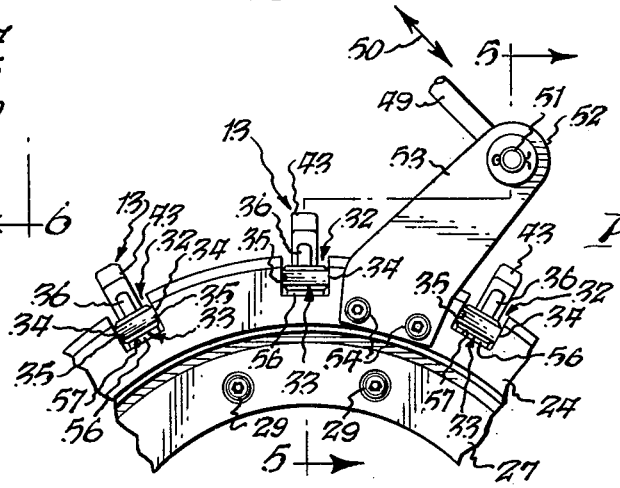
Fig. 6.
Fig. 8.
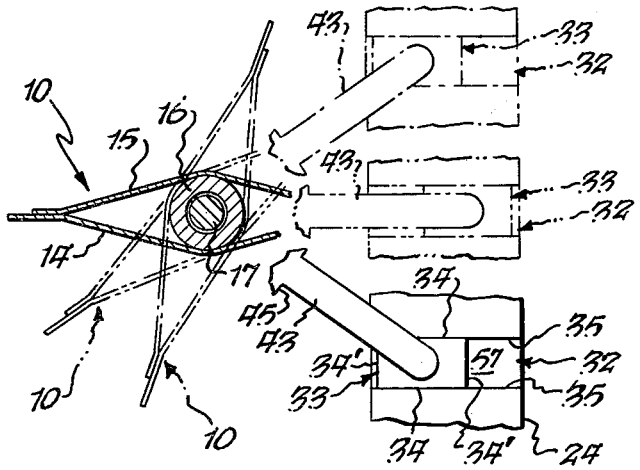
Fig. 9.
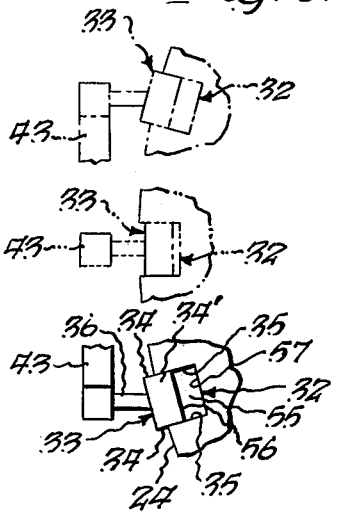

ADJUSTING MECHANISM FOR VARIABLE INLET VANE

BACKGROUND OF THE INVENTION

The present invention relates to an improved construction for adjusting the position of variable inlet vanes of fans or the like.

By way of background, there are numerous types of adjusting mechanisms which are used. However, these adjusting mechanisms have various deficiencies. In this respect, certain prior art mechanisms included linkages which were extremely complex. Others utilized gear ring constructions which developed looseness in use. Yet others utilized a point or line contact between relatively movable linkage members, which resulted in wear at the points of contact with attendant undesirable looseness between the parts. Prior art adjustment mechanisms are characterized by U.S. Pat. Nos. 2,606,713; 2,923,495, 3,074,689, 3,289,919, 3,352,537 and 3,392,958. It is with the overcoming of the deficiencies of prior art constructions that the present invention is concerned.

SUMMARY OF THE INVENTION

It is accordingly the object of the present invention to provide an improved variable inlet vane adjusting construction which is extremely simple and which will wear well in use so that large amounts of play between relatively movable parts of the adjusting construction is not experienced.

Another object of the present invention is to provide a variable inlet vane adjusting construction which is easy to repair and easy to assemble. Other objects and attendant advantages of the present invention will readily be perceived hereafter.

The improved variable inlet vane adjusting construction of the present invention comprises a hub, a vane having an axis mounted at an acute angle to the axis of said hub, first pivot means mounting said vane for pivotal movement on said hub, an adjusting ring, means mounting said adjusting ring for circumferential sliding movement on said hub about the axis of said hub, a plurality of spaced axial slots on said adjusting ring, first opposed sides on said slots, a bearing of substantially solid rectangular configuration in each of said axial slots, each of said bearings having opposite second sides in face-to-face slidable engagement with said first sides, a plurality of pin members each having first and second end portions, second pivot means pivotally mounting said first end portion of each pin member on a bearing for movement relative to said bearing in three planes, a plurality of levers having first and second ends, means for fixedly attaching said first end of each of said levers to a vane, and means for fixedly attaching said second ends of each of said levers to a second end of each of said pins whereby rotation of said adjusting ring causes pivotal movement of said vanes while said first and second sides remain in full face-to-face engagement. The present invention will be more fully understood when the following portions of the specification are read in conjunction with the accompanying drawings wherein:

BRIEF DESCRIPTION OF THE DRAWINGS

FIG. 5 is a fragmentary cross sectional view taken substantially along line 5—5 of FIG. 6 and showing the various components of the adjusting mechanism;

FIG. 6 is a fragmentary side elevational view taken substantially in the direction of arrows 6—6 of FIG. 5 and showing the relationship between the adjusting ring and the bearings therein;

FIG. 7 is a fragmentary cross sectional view taken substantially along line 7—7 of FIG. 5 and showing the pivotal mounting between the bearing and the pin mounted thereon;

FIG. 8 is a fragmentary schematic view showing a vane in various degrees of adjustment; and FIG. 9 is a fragmentary schematic view taken in the direction of arrows 6—6 of FIG. 5 and showing the various orientations which the pin assumes relative to a bearing.

DESCRIPTION OF THE PREFERRED EMBODIMENTS

Figure 1:
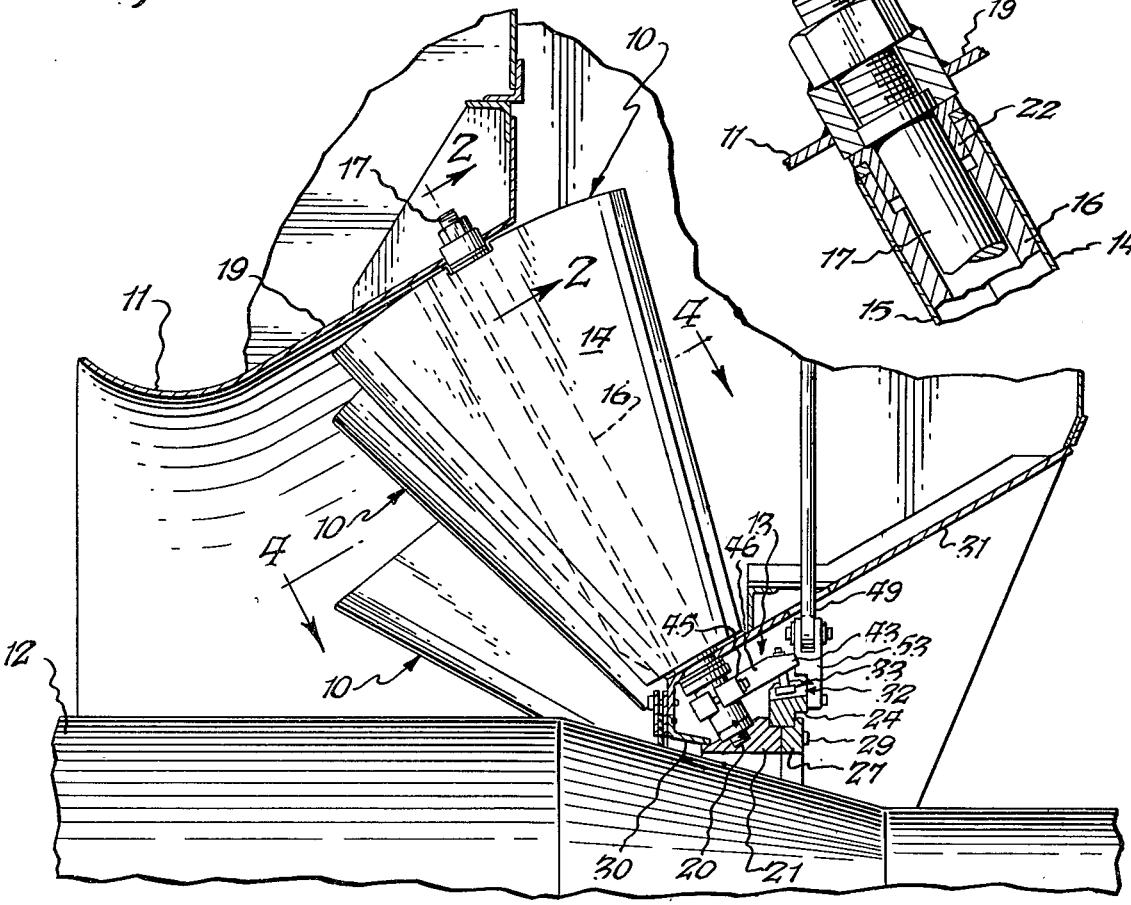
FIG. 1 is a fragmentary view, partially in cross section, showing a pivotally mounted variable inlet vane and the adjusting mechanism therefor.
Figure 2:
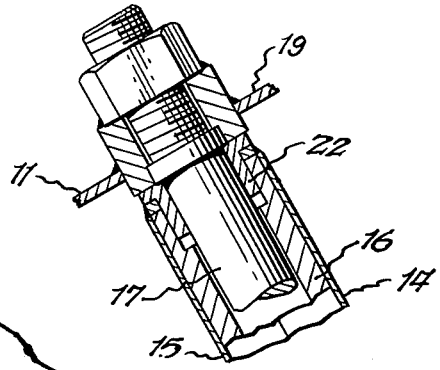
FIG. 2 is a fragmentary cross sectional view taken substantially along line 2—2 of FIG. 1 and showing the manner in which the outer end of the vane is mounted for pivotal movement.
Figure 3:
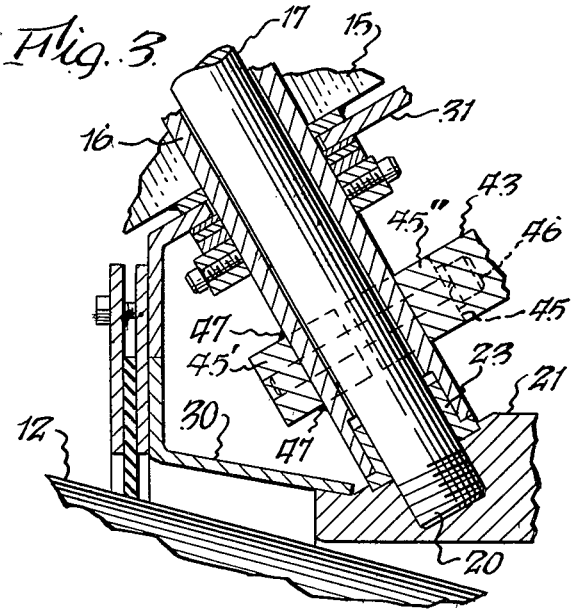
FIG. 3 is a fragmentary cross sectional view taken substantially along line 3—3 of FIG. 4 and showing the manner in which the inner end of the vane is mounted for pivotal movement.

The improved vane adjusting construction of the present invention is used to adjust the position of vanes 10 mounted for pivotal movement within an inlet bell 11 associated with a fan (not shown) mounted on shaft 12, as is well known in the art. Each of vanes 10 has an adjusting mechanism 13 (FIG. 5) associated therewith. The structure of each vane 10 includes sheet metal sides 14 and 15 which are secured to central tube 16, which in turn is pivotally mounted on shaft 17, the upper end of which is fixedly secured to inlet bell housing 19, as shown in FIG. 2, and the lower end 20 of which is threaded into annular fan hub 21, as shown in FIG. 3. The axis of shaft 17 extends at an acute angle to the axis of hub 21. The specific details of the mounting structures for the opposite ends of shaft 17 form no part of the present invention and accordingly a detailed description thereof will not be made. It is only necessary to understand that shaft 17 is fixedly secured between shell 19 and annular hub 21. The upper end of tubular member 16 is mounted on bearing 22 on shaft 17 and the lower end is mounted on bearing 23 on shaft 17.

The adjusting structure 13 includes an annular adjusting ring 24 having an inner portion 25 which is received in annular groove 26 formed between annular hub portion 21 and annular hub portion 27 which is secured thereto by a plurality of circumferentially spaced bolts 29. By virtue of the foregoing connection, adjusting ring 24 can slide circumferentially in groove 26. The hub 21 is suitably attached to annular housing portion 30 which is an extension of duct portion 31. A plurality of axial slots 32 (FIG. 6) are circumferentially spaced about the outer periphery of adjusting ring 24. A rectangular bearing 33 has its opposite sides 34 in sliding engagement with the opposite sides 35 of slot 32. A pin 36 has one end press-fitted into spherical bearing 37 which is journalled in race 39 which in turn is held within bearing 33 by snap ring 40. Because of this connection, bearing 37 can swivel in all directions within its race 39, as governed by the geometry of the structure. The upper end 41 (FIG. 5) of pin 36 is press-fitted within bore 42 of lever 43 and is fixedly fastened therein by means of screw 44, as shown in FIG. 5. The opposite end of lever 43 has a clamping collar 45 associated therewith which consists of lower collar portion 45' and upper collar portion 45'', each of which fit in complementary mating relationship with tube 16. Collar portion 45' is welded to tube 16, and diametrically spaced screws 46 releasably tighten clamping collar portion 45'' to portion 45'. Lever 43 is an integral extension of collar portion 45''.

Figure 4:
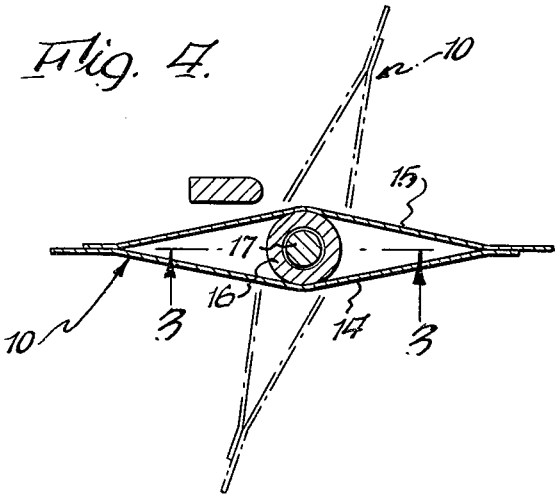
FIG. 4 is a fragmentary cross sectional view taken substantially along line 4—4 of FIG. 1 and showing the limits of rotation of the vane.

Whenever it is desired to simultaneously adjust the position of vanes 10, adjusting ring 24 is slid circumferentially in groove 26 by moving link 49 in the direction of arrows 50. Link 49 is mounted on pin 51 (FIG. 5) which straddles bifurcated end 52 of link 53 which is attached to adjusting ring 24 by means of bolts 54. The movement of adjusting ring 24 in a circumferential direction will cause bearings 33 to slide in a generally axial direction in slots 32. At the same time, the circumferential movement of adjusting ring 24 will be transmitted through pins 36 to levers 43 which in turn will cause pivotal movement of vanes 10 about the axes of shafts 17, which in turn will move vanes 10 between their open and closed limits, as shown in FIGS. 4 and 8. The spherical bearing 37 permits the foregoing action to take place in view of the fact that there is a universal fit between bearing 37 and its race 39 which permits pin 36 to assume any required pivotal position relative to bearing 33. Furthermore, it is to be noted that there is a space 55 (FIG. 5) between the bottom surface 56 of rectangular solid bearing 33 and the bottom wall 57 of slot 32. This clearance prevents binding between the bottom surface of the bearing and the bottom wall of the slot, inasmuch as the space between these two portions vary with the circumferential position of adjusting ring 24.

As can be seen, the bottom wall 57 is inclined to the horizontal at approximately 10°. This is essentially the angle at which the bottom surface 56 of bearing 33 will track during pivotal movement of adjusting ring 24. Therefore, the space 55 will tend to remain substantially constant, although it does vary with the circumferential position of adjusting ring 24.

The square bearing 33 carrying the spherical bearing 37 provides a truly universal fit between pin 36 and adjusting ring 24, thereby obviating any binding which might otherwise be experienced during adjustment. In this respect, bearing 37 permits pivotal movement of pin 36 in three planes, namely, the X, Y and Z planes. In addition, the parallel sides 34 of bearing 33 have full surface contact with the parallel sides 35 of slots 32, thereby avoiding the line or point contact of previous constructions and thus prolonging the life of the bearings. Furthermore, bearing 33 is of the self-lubricating variety which does not require frequent lubrication. The bearing 33 has been described as being of rectangular solid configuration, but more specifically it is square in plan. Therefore, after two sides 34 have been worn in use, the bearing can be rotated 90° about the axis of pin 36 and sides 34' can be placed in engagement with slot sides 32. It is to be especially noted that there is always full face-to-face engagement between bearing sides 34 and slot sides 32 in all positions of the vanes. Thus, there is almost no tendency for the connection between these faces to become loose, which in turn, could cause the vanes 10 to flutter.

It can thus be seen that a good solid connection is provided for adjusting the vanes and the tendency of the parts to wear very little results in accurate adjustment of the vanes. Furthermore, because of the simplicity of the structure, there is the advantage of great ease of replacement of parts and ease of overall maintenance.

While a preferred embodiment of the present invention has been disclosed, it will be appreciated that the present invention is not limited thereto, but may be otherwise embodied within the scope of the following claims.

What is claimed is:

1. A variable inlet vane adjusting construction comprising a hub, a vane having an axis mounted transversely to the axis of said hub, first pivot means mounting said vane for pivotal movement on said hub, an adjusting ring, means mounting said adjusting ring for circumferential sliding movement on said hub about said axis of said hub, a plurality of circumferentially spaced axial slots on said adjusting ring, first opposed sides on said slots, a bearing of substantially solid rectangular configuration in each of said axial slots, each of said bearings having opposite second sides in face-to-face slidable engagement with said first sides, a plurality of pin members each having first and second end portions, second pivot means pivotally mounting said first end portion of each pin member on one of said bearings for movement relative to said bearing in three planes, a plurality of levers having first and second ends, means for fixedly attaching said first end of each of said levers to a vane, and means for fixedly attaching said second ends of each said levers to a second end of each of said pins, whereby rotation of said adjusting ring causes pivotal movement of said vanes while said first and second sides remain in full face-to-face engagement.

2. A variable inlet vane adjusting construction as set forth in claim 1 wherein each of said bearings is square in plan whereby each pair of opposite sides of said bearings can be selectively placed in engagement with said first sides.

3. A variable inlet vane adjusting construction as set forth in claim 1 wherein said second pivot means comprises a spherical bearing.

4. A variable inlet vane adjusting construction as set forth in claim 3 wherein said first end portions of each of said pin members is press-fitted into a spherical bearing.

* * * * *